US006936392B2

(12) United States Patent
Sato

(10) Patent No.: US 6,936,392 B2
(45) Date of Patent: Aug. 30, 2005

(54) DEVELOPING AGENT

(75) Inventor: Shuitsu Sato, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 9 days.

(21) Appl. No.: 10/342,368

(22) Filed: Jan. 15, 2003

(65) Prior Publication Data

US 2004/0137351 A1 Jul. 15, 2004

(51) Int. Cl.[7] ..... G03G 9/087

(52) U.S. Cl. ..... 430/109.3; 430/109.4; 430/108.8; 430/108.4; 430/124

(58) Field of Search ..... 430/124, 108.4, 430/108.8, 109.4, 109.3, 111.4

(56) References Cited

U.S. PATENT DOCUMENTS 5,292,609 A * 3/1994 Yoshikawa et al. ..... 430/108.8
6,057,076 A * 5/2000 Berkes et al. ..... 430/137.18
2002/0042013 A1 * 4/2002 Aoki et al. ..... 430/108.8
2003/0108808 A1 * 6/2003 Inoue et al. ..... 430/108.8
2004/0043318 A1 * 3/2004 Sato et al. ..... 430/108.8

OTHER PUBLICATIONS

English language machine translation of JP 08–106173.*
U.S. Appl. No. 10/985,022, filed Nov. 10, 2004, Sato et al.
U.S. Appl. No. 10/293,323, filed Nov. 14, 2002, Sato et al.
U.S. Appl. No. 10/230,136, filed Aug. 29, 2002, Sato et al.
U.S. Appl. No. 10/358,235, filed Feb. 5, 2003, Sato et al.
U.S. Appl. No. 10/391,602, filed Mar. 20, 2003, Sato et al.
U.S. Appl. No. 10/293,323, filed Nov. 14, 2002, Urabe et al.

* cited by examiner

*Primary Examiner*—Christopher Rodee
(74) *Attorney, Agent, or Firm*—Foley & Lardner LLP

(57) ABSTRACT

Disclosed is a developing agent using a binder resin including a styrene-acrylic-series resin, a crystalline polyester resin, a first wax having a melting point higher than the softening point of the crystalline polyester resin, and a second wax having a melting point lower than the softening point of the crystalline polyester resin.

15 Claims, 1 Drawing Sheet

DEVELOPING AGENT

BACKGROUND OF THE INVENTION

The present invention relates to a developing agent used in an image forming apparatus such as an electrostatic copying machine or a laser beam printer.

The heat roll fixing method is advantageous over other fixing methods in that it is possible to obtain a strong fixed image at high speed, in that the energy conversion efficiency is high, and in that the detrimental effect on the environment by the evaporation of, for example, solvent is small.

On the other hand, it has been pointed out that the heat roll fixing method gives rise easily to a so-called "low-temperature offset" phenomenon and a so-called "high-temperature offset" phenomenon, in which the toner image is brought into direct contact with the fixing roll or the belt at a low or a high temperature.

The low-temperature offset phenomenon represents the phenomenon that the toner image is not sufficiently melted at a low temperature and, thus, the toner is cracked when the toner image is brought into contact with the fixing roller. On the other hand, the high-temperature offset phenomenon represents the phenomenon that the toner is excessively melted at a high temperature so as to cause the molten toner to be attached to, for example, the fixing roll.

It is desirable for the low-temperature offset phenomenon to be generated under a lower temperature and for the high-temperature offset phenomenon to be generated under a higher temperature. Along this line, various ideas have been proposed to date. As some of these proposals, it is known in the art to broaden the molecular weight distribution of the binder resin and to add as a releasing agent a low-molecular-weight polypropylene series resin having a prescribed range of molecular weight distribution to the binder resin. In addition, it is proposed to add two kinds of wax component to the toner in order to obtain a toner excellent in low-temperature fixing properties and in resistance to the offset phenomenon.

On the other hand, in view of energy saving, it is desirable to shorten the waiting time until the fixing device is heated to the temperature at which the fixing device is operated and to carry out the fixing at a lower temperature. As a method for lowering the fixing temperature, it is known in the art to use a toner containing a crystalline polyester and an amorphous polyester resin as a binder resin, as disclosed in, for example, Jpn. Pat. Appln. KOKAI Publication No. 2001-222138.

However, even the toner referred to above fails to satisfy all the required performances so as to give rise to some problems. To be more specific, the particular toner is incapable of satisfying both the resistance to the offset phenomenon at a low temperature and the resistance to the offset phenomenon at a high temperature. For example, toner which is excellent in its resistance to the offset phenomenon at a high temperature and in its developing properties is insufficient in its fixing properties at a low temperature. In contrast, toner which is excellent in its resistance to the offset phenomenon at a low temperature and in its fixing properties at a low temperature is somewhat poor in its resistance to blocking and in its developing properties.

BRIEF SUMMARY OF THE INVENTION

An object of the present invention is to provide a developing agent, which is excellent in any of the fixing properties at a low temperature, the resistance to the offset phenomenon at a low temperature, the resistance to the offset phenomenon at a high temperature, the resistance to smear, and the resistance to blocking, and which permits obtaining a stable charging property and an image concentration over a long time even if the environment is changed.

The developing agent of the present invention comprises toner particles containing a binder resin including a styrene-acrylic-series resin, a crystalline polyester resin, a first wax having a melting point higher than the softening point of the crystalline polyester resin, and a second wax having a melting point lower than the softening point of the crystalline polyester resin, and a coloring agent.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the preferred embodiments given below, serve to explain the principles of the present invention.

DETAILED DESCRIPTION OF THE INVENTION

The developing agent according to a first aspect of the present invention comprises a coloring agent and a binder resin. The binder resin includes a styrene-acrylic-series resin, a crystalline polyester resin and first and second waxes differing from each other in the melting point. To be more specific, the first wax has a softening point higher than the softening point of the crystalline polyester resin. Also, the second wax has a softening point lower than the softening point of the crystalline polyester resin.

The styrene-acrylic-series resin used in the present invention exhibits amorphous melting characteristics. On the other hand, the crystalline polyester resin used in the present invention exhibits crystalline melting characteristics.

Figure 1:
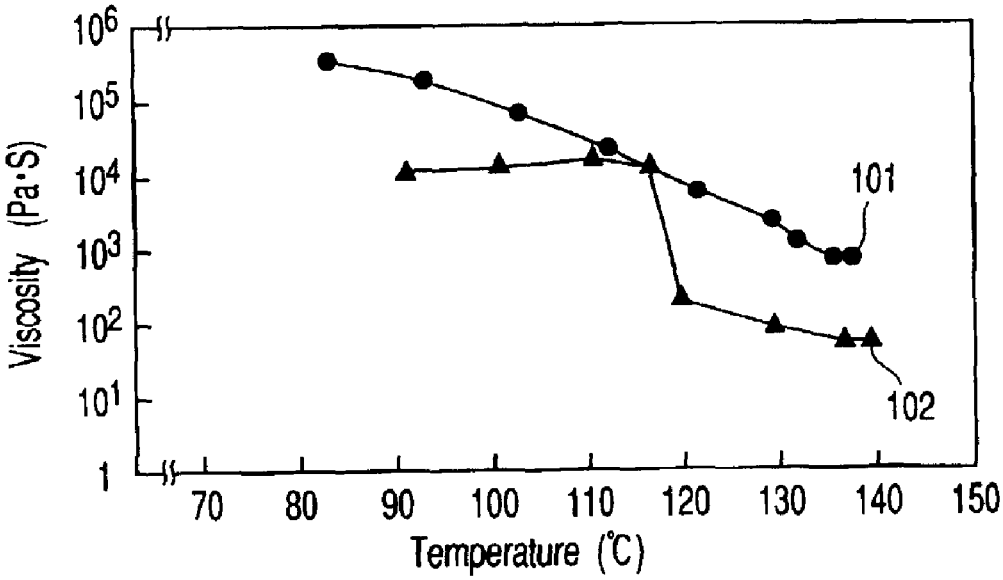
FIG. 1 is a graph showing the relationship between the melt viscosity of the polyester resin and the temperature.

The differences between the polyester resin exhibiting crystalline characteristics and the polyester resin exhibiting amorphous characteristics will now be described with reference to the graph of FIG. 1 showing the melting characteristics.

To be more specific, FIG. 1 is a graph showing the relationship between the melt viscosity and the temperature in respect of a polyester resin exhibiting crystalline characteristics and having a softening point of 120° C. and another polyester resin exhibiting amorphous characteristics and having a softening point of 105° C. Curve 101 shown in FIG. 1 represents the polyester resin exhibiting amorphous characteristics, and curve 102 represents the polyester resin exhibiting crystalline characteristics.

As apparent from curve 101 shown in FIG. 1, the viscosity of the polyester resin exhibiting amorphous characteristics is moderately decreased with increase in the temperature over a wide temperature range. On the other hand, the polyester resin exhibiting crystalline characteristics has a narrow temperature range within which the viscosity is rapidly decreased with increase in the temperature, as apparent from curve 102 shown in FIG. 1.

The fixing method employed in the present invention comprises fixing a developing agent image obtained by using the developing agent to a transfer material.

In the fixing step, it is possible to heat the developing agent image transferred onto the transfer material at a heating temperature not lower than the softening point of the binder resin. Also, it is possible for the softening point of the binder resin to be dependent on the softening point of the styrene-acrylic-series resin. Further, it is possible to heat and pressurize the transfer material and the developing agent image.

The image forming apparatus that can be used in the present invention, which is an image forming apparatus to which is applied the developing agent of the present invention, comprises:

an image carrier;

a developing device arranged to face the image carrier, housing the developing agent, and developing the electrostatic latent image formed on the image carrier in accordance with the image information so as to form a developing agent image;

a transfer device for transferring the developing agent image onto a transfer material; and a fixing device for fixing the developing agent image transferred onto the transfer material.

According to the present invention, the binder resin contained in the developing agent includes a styrene-acrylic-series resin and a polyester resin, which is crystalline and has a narrow temperature range within which the viscosity is rapidly lowered with increase in the temperature. The use of the styrene-acrylic-series resin and the crystalline polyester resin in combination permits improving the fixing properties at a low temperature.

Also, according to the present invention, the binder resin contained in the developing agent includes a first wax having a melting point higher than the softening point of the crystalline polyester resin. The first wax and the crystalline polyester resin collectively produce a synergetic effect so as to further improve the resistance to the offset phenomenon at a high temperature.

In addition, according to the present invention, the binder resin contained in the developing agent includes a second wax having a melting point lower than the softening point of the crystalline polyester resin. The second wax and the crystalline polyester resin collectively produce a synergetic effect so as to improve not only the fixing properties at a low temperature but also the resistance to the offset phenomenon at a low temperature.

As described above, the developing agent of the present invention comprises a styrene-acrylic-series resin exhibiting amorphous characteristics, a crystalline polyester resin, and two kinds of waxes having melting points higher and lower, respectively, than the melting points of the softening point of the crystalline polyester resin. The particular construction of the developing agent permit sufficiently suppressing the high-temperature offset phenomenon and the low-temperature offset phenomenon so as to further improve the fixing properties under a low temperature.

It is possible to set the softening points of the styrene-acrylic-series resin and the crystalline polyester resin in accordance with the fixing temperatures. In general, the fixing temperature of the developing agent is in the range of 140 to 210° C. In this case, the softening point of the styrene-acrylic-series resin should be in the range of 120 to 160° C. Also, the softening point of the crystalline polyester resin should be in the range of 100 to 140° C.

Also, it is possible for the softening points of the styrene-acrylic-series resin and the crystalline polyester resin to be the same or different. Preferably, the softening point of the styrene-acrylic-series resin should desirably be higher than the softening point of the crystalline polyester resin by 0 to 60° C.

In this case, it is possible for the styrene-acrylic-series resin to have a relatively large difference of 60 to 110° C. between the glass transition point and the softening point. On the other hand, the crystalline polyester resin exhibits crystalline characteristics as its melting characteristics and, thus, it is possible for the crystalline polyester resin to have a small difference of 0.1 to 10° C. between the glass transition point and the softening point. Incidentally, concerning the glass transition point and the softening point, it is possible for the glass transition point to be higher than or lower than the softening point.

The melting point of the first wax is higher than the softening point of the crystalline polyester resin by, preferably, at least 8° C., more preferably by 8 to 40° C. Also, the melting point of the second wax is lower than the softening point of the crystalline polyester resin by, preferably at least 10° C., more preferably by 10 to 50° C.

The mixing ratio by weight of the styrene-acrylic-series resin to the crystalline polyester resin should preferably be 60 to 95:5 to 40, more preferably 60 to 80:20 to 30. If the mixing ratio falls within the range noted above, the developing agent tends to be rendered excellent in any of the fixing properties at a low temperature, the resistance to the offset phenomenon at a low temperature, and the resistance to smear. However, if the mixing ratio noted above fails to fall within the range noted above, the developing agent tends to be rendered poor in any of the fixing properties at a low temperature, the resistance to the offset phenomenon at a low temperature, the resistance to the offset phenomenon at a high temperature, and the resistance to smear.

The softening point referred to in the present specification is determined by using CFT-500 (trade name of an overhead flow tester manufactured by Shimazu Seisakusho K.K.). Specifically, 1 $cm^3$ of a sample is melted and allowed to flow through a nozzle having a length of 1 mm and provided with a fine hole having a diameter of 1 mm under a load of 20 $kg/cm^2$ and a temperature elevation rate of 6° C./min. The temperature of the molten sample at the position corresponding to ½ of the height between the starting point and the end point of the molten sample flowing downward is defined to be the softening point.

On the other hand, the glass transition point used in the present specification is defined by the method specified in ASTM D3418-82.

In the ASTM method referred above, the cross point between the inclination of the heat absorption peak measured by employing the DSC method and the inclination of the base line is defined to be the glass transition point. To be more specific, 10 mg of a sample is heated to 180° C. by using a differential scanning calorimeter such as DSC-200 manufactured by, for example, Seiko Denshi Kogyo K.K. with alumina used as a reference. The sample is left at the heated temperature for 10 minutes, followed by cooling the heated sample to room temperature at the cooling rate of 10° C./min. Then, the sample is measured at the temperature elevation rate of 10° C./min, followed by determining the cross point between the extension of the base line at 50° C. or less and the maximum inclination between the rising point of the heat absorption peak and the top of the peak. The cross point thus determined is defined to be the glass transition point in the present specification.

The styrene-acrylic-series resins used in the present invention include, for example, polymers of styrenes, copolymers between styrenes and dienes, and copolymers between styrenes and alkyl methacrylate or acrylate. Among these resins, it is desirable to use the polymers of styrenes, the copolymers between the styrenes and dienes, the copolymers between styrenes and alkyl methacrylate or alkyl acrylate having an alkyl group having 8 to 24 carbon atoms, and a mixture thereof.

The styrenes constituting the polymers of styrenes include, for example, styrene, α-methyl styrene, p-methyl styrene, m-methyl styrene, p-methoxy styrene, p-hydroxy styrene, and p-acetoxy styrene. Among these styrenes, it is desirable to use styrene and a combination of styrene and another styrene compound. Particularly, it is desirable to use styrene.

The styrenes forming the copolymers together with the dienes include, for example, styrene, α-methyl styrene, p-methyl styrene, m-methyl styrene, p-methoxy styrene, p-hydroxy styrene, and p-acetoxy styrene. Among these styrenes, it is desirable to use styrene and a combination of styrene-and another styrene compound. Particularly, it is desirable to use styrene. On the others, the dienes used in the present invention for forming the copolymer together with the styrenes include, for example, butadiene, isoprene, chloroprene, hexadiene and octadiene. Among these diene compounds, it is desirable to use butadiene, isoprene and chloroprene. Particularly, it is desirable to use butadiene and isoprene.

The styrenes used in the present invention for preparation of the copolymers between the styrenes and an alkyl methacrylate or alkyl acrylate include, for example, styrene, α-styrene, p-methyl styrene, m-methyl styrene, p-methoxy styrene, p-hydroxy styrene, and p-acetoxy styrene. Among these styrene compounds, it is desirable to use styrene and a combination of styrene and another styrene compound. Particularly, it is desirable to use styrene. On the other hand, the alkyl methacrylate and the alkyl acrylate used in the present invention include, for example, methyl methacrylate, methyl acrylate, ethyl methacrylate, ethyl acrylate, butyl methacrylate, butyl acrylate, 2-ethylhexyl methacrylate, 2-ethylhexyl acrylate, decyl methacrylate, decyl acrylate, lauryl methacrylate, lauryl acrylate, tetradecyl methacrylate, tetradecyl acrylate, hexadecyl methacrylate, hexadecyl acrylate, stearyl methacrylate, stearyl acrylate, behenyl methacrylate and behenyl acrylate. Among these alkyl methacrylates and alkyl acrylates, it is desirable to use a long chain alkyl methacrylate and a long chain alkyl acrylate having an alkyl group having 8 to 24, more preferably 12 to 22 carbon atoms. Particularly, it is desirable to use lauryl methacrylate, lauryl acrylate, stearyl methacrylate and stearyl acrylate.

The crystalline polyester resin used in the present invention can be prepared by using monomers containing carboxylic acid components consisting of polyhydric carboxylic compounds having a valency of at least two and the alcohol components consisting of polyhydric alcohols having a valency of at least two. The acid components referred to above include, for example, fumaric acid, maleic acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, succinic acid having an alkyl group with 1 to 20 carbon atoms or an alkenyl group with 2 to 20 carbon atoms substituted therein such as dodecenyl succinic acid or octyl succinic acid, anhydrides of these acids, and derivatives thereof such as alkyl esters. On the other hand, the alcohol components used in the present invention include, for example, aliphatic polyols such as ethylene glycol, propylene glycol, 1,4-butane diol, 1,3-butane diol, 1,5-pentane diol, 1,6-hexane diol, neopentane glycol, glycerin, trimethylol ethane, trimethylol propane, pentaerythritol, alicyclic polyols such as 1,4-cyclohexane dimethanol, 1,4 cyclohexanedimethanol, and an ethylene oxide adduct or a propylene oxide adduct such as bisphenol A. Particularly, it is desirable to use a crystalline compound, which is generally waxy, obtained by the polycondensation between an alcohol component having an alkyl or alkenyl group having at least 16 carbon atoms and containing at least 80 mol % of a diol having 2 to 6 carbon atoms and a carboxylic component containing at least 80 mol % of fumaric acid. The crystalline compound noted above is a resin having a softening point of 100 to 140° C., and a glass transition point of 100 to 140° C., the difference between the melting point and the glass transition point being in the range of 0.1 to 10° C. These crystalline compounds can be used singly or in the form of a mixture of at least two of these crystalline compounds.

At least two kinds of waxes including a wax having a melting point higher than the softening point Sp2 of the crystalline polyester resin by at least 10° C. and another wax having a melting point lower than the softening point Sp2 of the crystalline polyester resin by at least 10° C. are used in the present invention as the first and second waxes, respectively.

The waxes meeting the particular requirements include, for example, aliphatic hydrocarbon waxes such as a low molecular weight polyethylene, a low molecular weight polypropylene, polyolefin copolymers, polyolefin wax, microcrystalline wax, paraffin wax and Fischer-Tropsch wax; oxides of aliphatic hydrocarbon series waxes such as oxidized polyethylene wax or block copolymers thereof; plant waxes such as candelilla wax, carnauba wax, Japan wax, jojoba wax, and rice wax; animal waxes such as beeswax, lanolin, and whale wax; mineral waxes such as ozokerite, ceresin, and petrolatum; waxes containing aliphatic esters as a main component such as a montanic acid ester wax, and a castor wax; and waxes prepared by deoxidizing partially or entirely a fatty acid ester such as a deoxidized carnauba wax.

The additional materials used in the present invention include, for example, saturated linear fatty acids such as palmitic acid, stearic acid, montanic acid, and a carboxylic acid having a long alkyl chain; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and an alcohol having more longer alkyl chain; polyhydric alcohols such as sorbitol; fatty acid amides such as linoleic acid amide, oleic acid amide, and lauric acid amide; saturated fatty acid bisamides such as methylene bis-stearic acid amide, ethylene bis-capric acid amide, ethylene bis-lauric acid amide, and hexamethylene bis-stearic acid amide; unsaturated fatty acid amides such as ethylene bis-oleic acid amide, hexamethylene bis-oleic acid amide, N,N'-dioleyl adipic acid amide, and N,N'-oleyl sebacic acid amide; aromatic bisamides such as m-xylene bis-stearic acid amide, and N,N'-distearyl isophthalic acid amide; metal salts of fatty acids, i.e., a so-called "metal soaps", such as calcium stearate, calcium laurate, zinc stearate and magnesium stearate; waxes prepared by grafting a vinyl monomer such as styrene or acrylic acid to an aliphatic hydrocarbon series wax; partial esters between a fatty acid such as behenic acid monoglyceride and a polyhydric alcohol; and methyl ester compounds having a hydroxyl group, which are obtained by hydrogenizing a plant oil and fat.

The waxes having a melting point lower by at least 10° C. than 140° C., i.e., melting point not higher than 130° C., include, for example, plant waxes and animal waxes such as candelilla wax having a melting point of 71° C., carnauba wax having a melting point of 83° C., rice wax having a melting point of 79° C., jojoba wax having a melting point of 95° C., white wax having a melting point of 53° C., and beeswax having a melting point of 64° C.; aliphatic hydrocarbon series waxes such as a paraffin wax having a melting point of 80 to 107° C.; metal salts of fatty acid having an acidic group (73° C.) such as a long chain ester wax having a melting point of 90 to 95° C., a fatty acid ester wax having a melting point of 60 to 82° C., and zinc stearate having a melting point of 123° C.; as well as montan wax having a melting point of 79 to 89° C., montanic acid ester wax having a melting point of 56 to 92° C., a maleic acid denatured wax having a melting point of 77 to 121° C., a microcrystalline wax having a melting point of 85 to 97° C., oxides thereof, and a low molecular weight polyethylene having a low density and having a melting point of 103 to 124° C. On the other hand, the waxes having a melting point higher by at least 10° C. than 100° C., i.e., a melting point not lower than 110° C., include, for example, a low molecular weight polyethylene having a high density and having a melting point of 124 to 133° C. an a low molecular weight polypropylene having a melting point of 145 to 164° C.

The first wax having a high melting point produces the effect of promoting the mold-releasing function, and the second wax having a low melting point produces the plasticizing function. Also, the wax having a high melting point contributes to the improvement in the resistance to the offset phenomenon under a high temperature, and the wax having a low melting point contributes to the improvement in the fixing properties under low temperatures.

The coloring agents used in the present invention include, for example, carbon black, an organic pigment and dye and an inorganic pigment and dye.

The carbon black used in the present invention includes, for example, acetylene black, furnace black, thermal black, channel black, and Ketchen black.

On the other hand, the pigments and dyes used in the present invention include, for example, fast yellow G, benzidine yellow, indo fast orange, irrgazine red, carmine FB, permanent bordeaux FRR, pigment orange R lithol red 2G, lake red C, rhodamine FB, rhodamine B lake, phthalocyanine blue, pigment blue, brilliant green B, phthalocyanine green, and quinacridone. These pigments and dyes can be used singly or in the form a mixture of at least two of these pigments and dyes.

It is possible to add, for example, a charge control agent to the developing agent of the present invention for controlling the amount of the frictional charge. Where, for example, a carbon black or a colorless pigment or dye is used as the coloring agent, it is desirable to use as the charge control agent a metal-containing azo compound containing at least one material selected from the group consisting of the complex compounds and complex salts of iron, cobalt, and chromium. On the other hand, where a colored pigment or dye is used as the coloring agent, it is possible to use as the charge control agent a metal-containing salicylic acid derivative compound containing at least one material selected from the group consisting of the complex compounds and the complex salts of zirconium, zinc, chromium and boron.

Where the developing agent of the present invention is used as a two component developing agent, it is possible to mix carrier particles having a particle diameter of about 80 to 40 $\mu$m with the toner particles. The carrier particle noted above includes a core particle represented by $(MO)_X(Fe_2O_3)_Y$, $X/Y<1.0$, where M represents a single or a plurality of metals selected from the group consisting of Li, Mg, Mn, Fe(II), Co, Ni, Cu, Zn, Cd, Sr, and Ba, has a silicone resin layer formed on the surface of the core material, and has a resistance of $1\times10^{10}$ to $3\times10^{11}$ Ω in a gap of 250V/6.5 mm.

It is possible to mix various additives with the developing agent of the present invention.

Specifically, it is possible to mix inorganic fine particles in an amount of 0.2 to 3% by weight based on the toner particles in order to control the flowability and the charging properties. The inorganic fine particles used in the present invention include fine particles of, for example, silica, titania, alumina, strontium titanate and tin oxide. These inorganic fine particles can be used singly or in the form of a mixture of at least two of these inorganic fine particles.

In view of the improvement in the environmental stability, it is desirable to use inorganic fine particles having the surfaces treated with a hydrophobic agent. In addition to the inorganic fine particles, it is also possible to add resin particles having a particle diameter not larger than 1 $\mu$m to the toner particles in order to improve the cleaning capability.

The developing agent of the present invention can be prepared by, for example, the step of preparing a binder resin material including a styrene-acrylic-series resin, a crystalline polyester resin, a first wax having a melting point higher than the softening point of the crystalline polyester resin, and a second wax having a melting point lower than the softening point of the crystalline polyester resin, and melting and kneading the binder resin material so as to obtain a kneaded mixture, the step of pulverizing and classifying the kneaded mixture so as to obtain toner particles, the step of mixing the toner particles with an additive so as to allow the additive to be attached to the surface of the toner particle, thereby obtaining a toner, the mixing step being carried out as required, and, as required, the step of mixing the toner with a carrier.

Preferably, it is desirable to use as the binder resin material a wax-containing styrene-acrylic-series resin obtained by adding at least one of the first wax and the second wax in the step of polymerizing the styrene-acrylic-series resin, and a wax-containing crystalline polyester resin obtained by adding at least one of the first wax and the second wax in the step of polymerizing the crystalline polyester resin. If the wax is added in advance in the step of the polymerization, it is possible to improve the dispersion capability of the first wax and the second wax so as to improve the fixing performance. Specifically, where the first wax is added in advance, it is possible to further improve the resistance to the offset phenomenon under a high temperature. On the other hand, where the second wax is added in advance, it is possible to further improve the resistance to the offset phenomenon under a low temperature and the fixing properties under a low temperature. In addition, it is possible to improve the charging stability.

More preferably, it is possible to use a first wax-containing styrene-acrylic-series resin prepared by adding the first wax in the step of the polymerization of the styrene-acrylic-series resin, and a second wax-containing crystalline polyester resin prepared by adding the second wax in the step of the polymerization of the crystalline polyester resin. In this case, it is possible to improve the dispersion capability of each of the first and second waxes, with the result that the fixing performances such as the resistance to the offset phenomenon under a high temperature, the resistance to the offset phenomenon under a low temperature, and fixing properties under a low temperature can be improved. In addition, the charging properties can be improved over a long period of time.

Alternatively, it is possible to use a second wax-containing styrene-acrylic-series resin obtained by adding the second wax in the step of polymerizing the styrene-acrylic-series resin, and a first wax-containing crystalline polyester resin obtained by adding the first wax in the step of polymerizing the crystalline polyester resin.

Further, both the first and second waxes can be added in the polymerizing step of the resin by adding the first wax in the step of polymerizing one of two different kinds of the resins and by adding the second wax in the step of polymerizing the other resin. In this case, the dispersion capability of the waxes are rendered satisfactory.

The present invention will now be described more in detail with reference to Examples of the present invention. In the following Examples, the expression "part" denotes the part by weight.

EXAMPLES

In the first step, various resins and carriers were prepared.

(Manufacture of Styrene-Acrylic-Series Resin)

Prepared were 85 parts of styrene, 15 parts by butyl acrylate, and 0.2 part of di-t-butyl peroxide terephthalate. Then, a mixture of these materials was put under a nitrogen gas atmosphere, and a suspension polymerization was carried out at 85° C. for 10 hours and, then, at 95° C. for 3 hours. The reaction mixture was cooled, filtered, washed with water and, then, dried at 50° C. so as to obtain a styrene-acrylic-series resin having a softening point of 130° C. and a glass transition point of 61° C.

(Manufacture of Wax-Containing Styrene-Acrylic-Series Resin)

Also, a suspension polymerization was carried out as in the manufacture of the styrene-acrylic-series resin described above, except that 7 parts of a low molecular weight polypropylene wax having a melting point of 145° C. was added as a first wax in the step of the suspension polymerization referred to above. As a result, obtained was a styrene-acrylic-series resin containing 3 parts of the low molecular weight polypropylene wax. The softening point and the glass transition point of the wax-containing styrene-acrylic-series resin thus obtained were found to be equal to the softening point and the glass transition point of the styrene-acrylic-series resin prepared first.

(Manufacture of Crystalline Polyester Resin)

A mixture consisting of 95 parts of 1,4-butane diol, 5 parts by glycerin, 100 parts of fumaric acid, and 5 parts by hydroquinone was subjected to a reaction at 150 to 170° C. for 5 hours, followed by elevating the temperature to 200° C. so as to carry out an additional reaction for one hour while gradually decreasing the reaction pressure. Then, the pressure of the reaction system was lowered to a vacuum of 8 kPa so as to carry out a reaction for one hour so as to obtain a crystalline polyester resin having a softening point of 125° C., and a glass transition point of 128° C., the difference between the softening point and the glass transition point being 3° C.

(Manufacture of Wax-containing Polyester Resin)

A crystalline polyester resin having 7 parts of rice wax added thereto was obtained as in the manufacture of the crystalline polyester resin described above, except that the polymerization was carried out by adding 15 parts of rice wax having a melting point of 79° C. as a second wax in the manufacturing process of the polyester resin. The melting point and the glass transition point of the wax-containing crystalline polyester resin thus obtained were equal to those of the crystalline polyester resin referred to above.

(Manufacture of Resin-Coated Carrier)

Preparation of Ferrite Core:

A mixture consisting of 14 mol % of MnO, 16 mol % of MgO and 70 mol % of $Fe_2O_3$ was pulverized and mixed by using a wet ball mill, followed by drying the pulverized mixture, which was retained at 950° C. for 4 hours. The pulverized mixture was further pulverized for 24 hours in a wet ball mill so as to obtain a slurry of the pulverized particles having a particle diameter of 5 μm or less. The resultant slurry was granulated and dried and, then, retained at 140° C. for 6 hours, followed by pulverization and classification so as to obtain a ferrite core having an average particle diameter of 33 to 64 μm. The ferrite core was found to consist of 14 mol % of MnO, 15 mol % of MgO, and 71 mol % of $Fe_2O_3$, and the value of X/Y for the formula $(MO)_X(Fe_2O_3)_Y$ referred to previously was 0.45.

Coating of Ferrite Core:

By using a fluidized bed formed of an amino group-substituted silicone resin, the resultant ferrite core was coated with 5 parts of the resin relative to 100 parts of the carrier. Further, baking was applied at 190° C. for 3 hours to the coated film thus obtained so as to obtain a carrier coated with the resin.

The resistivity of the 250V/6.5 mm gap of the carrier thus obtained was found to be $2\times10^{11}$ Ω·cm.

Examples of the present invention and Comparative Examples were carried out as follows by using the resins and the carriers thus obtained.

Example 1

Prepared was a binder resin material 1 of the composition given below:

| Composition of Binder Resin Material 1 | |
|---|---|
| Styrene-acrylic-series resin | 70 parts |
| Crystalline polyester Resin | 30 parts |
| Low molecular weight polypropylene wax (melting point of 145° C.) | 2 parts |
| Rice wax (melting point of 78° C.) | 2 parts |

A coloring agent and a charge control agent were added to the binder resin material 1 given above in amounts given below, and these materials were mixed by using a Henschel mixer:

| | |
|---|---|
| Binder resin material 1 | 100 parts |
| Coloring agent (carbon black) | 4 parts |
| Charge control agent (iron complex salt azo compound) | 2 parts |

Then, the mixture was melted and kneaded by using a biaxial extruder.

The kneaded material thus obtained was cooled and, then, roughly pulverized by using a hammer mill, followed by finely pulverizing the roughly pulverized material and subsequently classifying the finely pulverized material so as to obtain toner particles having a volume average particle diameter of 9 μm.

Further, 100 parts of the toner particles thus obtained were mixed with 0.5 part of a hydrophobic silica and 0.5 part of a hydrophobic titanium oxide by using a Henschel mixer so as to manufacture a toner.

Still further, a developing agent was prepared by mixing 8 parts of the toner thus manufactured with 100 parts of the carrier coated with the resin by using a Nowter mixer.

An evaluating test was applied as follows to the developing agent thus obtained.

The evaluating test apparatus was prepared by revising the fixing device portion of Premarju 45 (trade name of a copying machine manufactured by Toshiba Tec K.K.).

Figure 2:
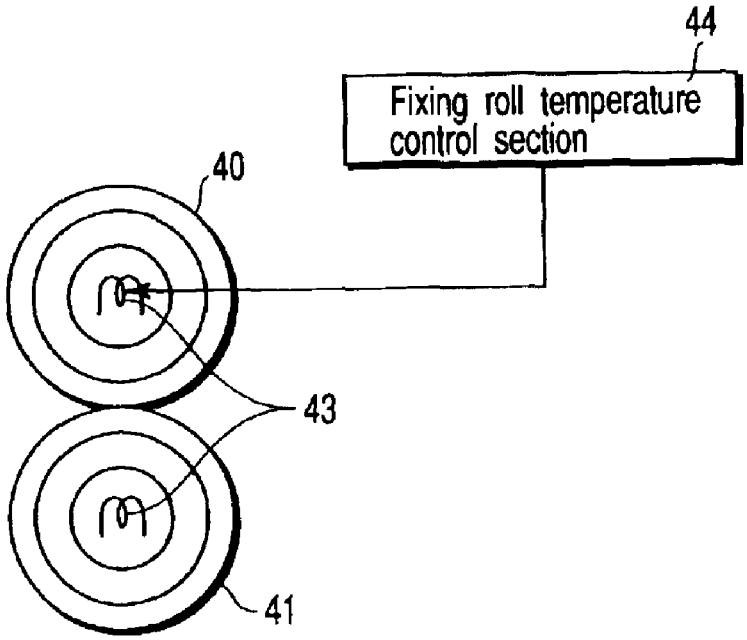
FIG. 2 schematically shows the construction of an apparatus used for conducting a fixing test.

FIG. 2 shows the construction of the fixing device used for the evaluating test of the developing agent of the present invention. The fixing device has been revised to permit the fixing roll temperature to be variable, and the evaluation was performed by fixing the unfixed image. The fixing device shown in FIG. 2 comprises a hard roller 40, a rubber roller 41 arranged to face the hard roller 40, a heat source 43 arranged within each of these rollers 40 and 41, and a fixing roll temperature control section 44 connected to the heat source 43. The hard roller 40 and the rubber roller 41 are in mutual contact with a prescribed pressure so as to have a nip portion with a prescribed width.

An image was formed in a manner to obtain an unfixed image by using the fixing device shown in FIG. 2. The image thus formed was evaluated in respect of the lowest fixing temperature, the non-offset range, the smear level, the charging properties, and the image concentration. Table 1 shows the results. Incidentally, the evaluating methods have been defined as follows.

The lowest fixing temperature has been defined as the temperature at which it is possible to obtain at least 75% of the fixation remaining rate.

For determining the fixation remaining rate, a transfer paper sheet having a toner image transferred thereonto under a load of 400N, a nip width of 7.5 mm, and the fixation forwarding rate of 200 mm/sec was subjected to a fixing treatment by the fixing device, with the temperature set for the heating roller of the fixing device successively elevated. The image concentration of the image portion of the fixed image thus formed was measured, and the image concentration was measured again after the image portion was rubbed with a 100% cotton pad. The lowest fixation rate was determined by the calculation according to the formula given below:

$$\text{Fixation remaining rate} = \frac{\text{Image concentration before the rubbing}}{\text{Image concentration after the rubbing}} \times 100(\%)$$

For measuring the non-offset range, the transfer paper sheet having a toner image transferred thereonto was subjected to a fixing treatment under the conditions described above, and the operation to observe whether or not stains with the toner are generated was conducted under the condition that the temperature set for the heating roller of the fixing device was successively elevated. The temperature range within which the stains with the toner are not generated, i.e., the temperature range within which any of the low-temperature offset phenomenon taking place in a low temperature region and the high-temperature offset phenomenon taking place in a high temperature region did not take place, was defined as the non-offset range.

The smear level was measured by preparing 10 stages of smear level samples and by referring to these smear level samples. The average values of the smear levels under temperatures falling within the non-offset range are shown in Table 1. Incidentally, the smaller value of the smear level denotes the lower degree of the stains with the toner.

For determining the charging properties, toners and carriers were left to stand for 12 hours under three conditions of L/L (low temperature and low humidity environment having a temperature 10° C. and a humidity of 20%), H/H (high temperature and high humidity environment having a temperature 35° C. and a humidity of 85%), and N/N (normal temperature and normal humidity environment having a temperature 20° C. and a humidity of 50%), followed by mixing the toners and the carriers at prescribed mixing ratios so as to prepare developing agents. The charging properties of each of these developing agents were measured by using a TB-220 type charging amount measuring apparatus manufactured by Toshiba Chemical K.K. and evaluated as follows:

Charging Properties (Difference in charging properties among L/L, H/H, and N/N)

◎: 3 μC/g or less

○: 3 to 7 μC/g

Δ: 7 to 10 μC/g x: 10 μC/g or more

For determining the image concentration, the images were printed out by using a copying machine Premarju 455 manufactured by Toshiba Tec K.K. under three conditions of L/L (low temperature and low humidity environment having a temperature 10° C. and a humidity of 20%), H/H (high temperature and high humidity environment having a temperature 35° C. and a humidity of 85%), and N/N (normal temperature and normal humidity environment having a temperature 20° C. and a humidity of 50%), followed by measuring the image concentration by using a Macbeth densitometer. The image concentration thus measured was evaluated as follows:

Image Concentration (Difference in image concentration among L/L, H/H, and N/N)

◎: 0.1 less

○: 0.1 to 0.2

Δ: 0.2 to 0.5 x: 0.5 or more

Example 2

Prepared was a binder resin material 2 of the composition given below:

| Composition of Binder Resin Material 2 | |
|---|---|
| Styrene-acrylic series resin | 80 parts |
| Crystalline polyester Resin | 20 parts |
| Low molecular weight polypropylene wax (melting point of 145° C.) | 2 parts |
| Rice wax (melting point of 78° C.) | 2 parts |

A developing agent was prepared as in Example 1, except that binder resin material 2 given above was used in place of binder resin material 1 used in Example 1.

Evaluation tests were conducted as in Example 1 in respect of the developing agent thus prepared. Table 1 also shows the results.

Example 3

Prepared was a binder resin material 3 of the composition given below:

| Composition of Binder Resin Material 3 | |
|---|---|
| Styrene-acrylic-series resin | 60 parts |
| Crystalline polyester Resin | 40 parts |
| Low molecular weight polypropylene wax (melting point of 145° C.) | 2 parts |
| Rice wax (melting point of 78° C.) | 2 parts |

A developing agent was prepared as in Example 1, except that binder resin material 3 given above was used in place of binder resin material 1 used in Example 1.

Evaluation tests were conducted as in Example 1 in respect of the developing agent thus prepared. Table 1 also shows the results.

Example 4

Prepared was a binder resin material 4 of the composition given below:

| Composition of Binder Resin Material 4 | |
|---|---|
| Wax-containing styrene-acrylic-series resin | 70 parts |
| Wax-containing crystalline polyester Resin | 30 parts |
| Low molecular weight polypropylene wax (melting point of 145° C.) | 2 parts |
| Rice wax (melting point of 78° C.) | 2 parts |

A developing agent was prepared as in Example 1, except that binder resin material 4 given above was used in place of binder resin material 1 used in Example 1.

Evaluation tests were conducted as in Example 1 in respect of the developing agent thus prepared. Table 1 also shows the results.

Example 5

Prepared was a binder resin material 5 of the composition given below:

| Composition of Binder Resin Material 4 | |
|---|---|
| Wax-containing styrene-acrylic-series resin | 80 parts |
| Wax-containing crystalline polyester Resin | 20 parts |
| Low molecular weight polypropylene wax (melting point of 145° C.) | 2 parts |
| Rice wax (melting point of 78° C.) | 2 parts |

A developing agent was prepared as in Example 1, except that binder resin material 5 given above was used in place of binder resin material 1 used in Example 1.

Evaluation tests were conducted as in Example 1 in respect of the developing agent thus prepared. Table 1 also shows the results.

Comparative Example 1

Prepared was a binder resin material 6 of the composition given below:

| Composition of Binder Resin Material 6 | |
|---|---|
| Styrene-acrylic-series resin | 70 parts |
| Low molecular weight polypropylene wax (melting point of 145° C.) | 2 parts |
| Rice wax (melting point of 78° C.) | 2 parts |

A developing agent was prepared as in Example 1, except that binder resin material 6 given above was used in place of binder resin material 1 used in Example 1.

Evaluation tests were conducted as in Example 1 in respect of the developing agent thus prepared. Table 1 also shows the results.

Comparative Example 2

Prepared was a binder resin material 7 of the composition given below:

| Composition of Binder Resin Material 7 | |
|---|---|
| Styrene-acrylic-series resin | 90 parts |
| Crystalline polyester Resin | 10 parts |
| Rice wax (melting point of 78° C.) | 2 parts |

A developing agent was prepared as in Example 1, except that binder resin material 7 given above was used in place of binder resin material 1 used in Example 1.

Evaluation tests were conducted as in Example 1 in respect of the developing agent thus prepared. Table 1 also shows the results.

TABLE 1

| | Lowest fixing temperature | Non-offset range | Smear level | Charging properties | Image concentration |
|---|---|---|---|---|---|
| Example 1 | 140° C. | 140 to 200 | 4 to 5 | ○ | ◎ |
| Example 2 | 145° C. | 145 to 210 | 5 to 6 | ◎ | ◎ |
| Example 3 | 130° C. | 135 to 210 | 4 to 5 | Δ | ○ |
| Example 4 | 135° C. | 135 to 230 | 3 to 5 | ○ | ◎ |
| Example 5 | 135° C. | 135 to 230 | 4 to 5 | ◎ | ◎ |
| Comparative Example 1 | 170° C. | 160 to 220 | 8 to 10 | ◎ | Δ |
| Comparative Example 2 | 150° C. | 160 to 190 | 7 to 8 | ○ | Δ |

As apparent from Table 1, in the case of using the developing agent of the present invention, it was possible to obtain practically satisfactory results in respect of any of the lowest fixing temperature, the non-offset range, the smear level, and the image concentration. However, where a crystalline polyester resin was not added as in Comparative Example 1, the low temperature fixing properties were poor, the low-temperature offset phenomenon was generated, and the resistance to the smear was lowered. Also, where one of the waxes, e.g., the first wax, was not added as in Comparative Example 2, the low-temperature offset phenomenon and the high-temperature offset phenomenon were generated, and the smear level was rendered poor.

In the case of using 80 parts of the styrene-acrylic-series resin and 20 parts of the crystalline polyester resin as in each of Examples 2 and 5, the charging properties and the image concentration were more improved than in the case of the other mixing ratio of the styrene-acrylic-series resin to the crystalline polyester resin. Where the mixing ratio of the styrene-acrylic-series resin is lowered as in Example 3, it was certainly possible improve the low temperature fixing properties and the resistance to the low-temperature offset phenomenon. However, it has been found that the charging properties and the image concentration tend to be lowered to some extent. Also, in the case of using a wax-containing resin in the polymerizing step as in Examples 4 and 5, it has been found that any of the low temperature fixing properties, the resistance to the low-temperature offset phenomenon, the resistance to the high-temperature offset phenomenon and the resistance to the smear can be further improved, compared with Examples 1 and 2. A particularly satisfactory result was obtained in the case of using a binder resin containing 80 parts of the wax-containing styrene-acrylic-series resin and 20 parts of the wax-containing polyester resin as in Example 2.

Additional advantages and modifications will readily occur to those skilled in the art. Therefore, the present invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent, comprising toner particles containing a binder resin including a styrene-acrylic-series resin, a crystalline polyester resin having a difference between the glass transition point and the softening point ranging from about 0.1 to 10° C., a first wax having a melting point higher than the softening point of the crystalline polyester resin, and a second wax having a melting point lower than the softening point of the crystalline polyester resin, and a coloring agent, wherein the mixing ratio by weight of the styrene-acrylic-series resin to the crystalline polyester resin falls within a range of 70 to 95:5 to 30.

2. A developing agent according to claim 1, wherein each of the difference between the softening point of the crystalline polyester resin and the melting point of the first wax and the difference between the softening point of the crystalline polyester resin and the melting point of the second wax is not smaller than 8° C.

3. A developing agent according to claim 1, wherein the softening point of the styrene-acrylic-series resin is in the range of 120 to 160° C., and the softening point of the crystalline polyester resin is in the range of 100 to 140° C.

4. A developing agent according to claim 3, wherein the softening point of the styrene-acrylic-series resin is higher by 0 to 60° C. than the softening point of the crystalline polyester resin.

5. A developing agent according to claim 1, wherein each of the first wax and the second wax is contained in the binder resin in an amount of 0.1 to 8 parts by weight relative to 100 parts by weight of the binder resin.

6. A developing agent according to claim 1, wherein the binder resin is obtained by kneading binder resin materials including a styrene-acrylic-series resin having the first wax added thereto in the polymerizing step and a crystalline polyester resin having the second wax added thereto in the polymerizing step.

7. A developing agent according to claim 1, wherein the binder resin is obtained by kneading binder resin materials including a styrene-acrylic-series resin having the second wax added thereto in the polymerizing step and a crystalline polyester resin having the first wax added thereto in the polymerizing.

8. A fixing method comprising fixing a developing agent image to a transfer material, wherein the developing agent comprises toner particles containing a binder resin including a styrene-acrylic-series resin, a crystalline polyester resin having a difference between the glass transition point and the softening point ranging from about 0.1 to 10° C., a first wax having a melting point higher than the softening point of the crystalline polyester resin, and a second wax having a melting point lower than the softening point of the crystalline polyester resin, and a coloring agent, wherein the mixing ratio by weight of the styrene-acrylic-series resin to the crystalline polyester resin falls within a range of 70 to 95:5 to 30.

9. A fixing method according to claim 8, comprising heating the developing agent image at a heating temperature not lower than the softening point of the binder resin.

10. A fixing method according to claim 8, wherein each of the difference between the softening point of the crystalline polyester resin and the melting point of the first wax and the difference between the softening point of the crystalline polyester resin and the melting point of the second wax is not smaller than 8° C.

11. A fixing method according to claim 8, wherein the softening point of the styrene-acrylic-series resin is in the range of 120 to 160° C., and the softening point of the crystalline polyester resin is in the range of 100 to 140° C.

12. A fixing method according to claim 11, wherein the softening point of the styrene-acrylic-series resin is higher by 0 to 60° C. than the softening point of the crystalline polyester resin.

13. A fixing method according to claim 8, wherein each of the first wax and the second wax is contained in the binder resin in an amount of 0.1 to 8 parts by weight relative to 100 parts by weight of the binder resin.

14. A fixing method according to claim 8, wherein the binder resin is obtained by kneading binder resin materials including a styrene-acrylic-series resin having the first wax added thereto in the polymerizing step and a crystalline polyester resin having the second wax added thereto in the polymerizing step.

15. A fixing method according to claim 8, wherein the binder resin is obtained by kneading binder resin materials including a styrene-acrylic-series resin having the second wax added thereto in the polymerizing step and a crystalline polyester resin having the first wax added thereto in the polymerizing step.

* * * * *